US006832907B2

(12) United States Patent
Spangenberg et al.

(10) Patent No.: US 6,832,907 B2
(45) Date of Patent: Dec. 21, 2004

(54) CONTROLLED MOULDING EQUIPMENT

(75) Inventors: Erik Spangenberg, Brædstrup (DK); Jesper B. Rasmussen, Brabrand (DK)

(73) Assignee: KVM Industrimaskiner A/S, Kjellerup (DK)

( * ) Notice: Subject to any disclaimer, the term of this patent is extended or adjusted under 35 U.S.C. 154(b) by 217 days.

(21) Appl. No.: 09/920,291

(22) Filed: Aug. 2, 2001

(65) Prior Publication Data

US 2002/0025357 A1 Feb. 28, 2002

(30) Foreign Application Priority Data

Aug. 23, 2000 (DK) ..... 2000 01247
Sep. 26, 2000 (DK) ..... 2000 01416

(51) Int. Cl.[7] ..... B28B 7/34

(52) U.S. Cl. ..... 425/253; 425/432; 425/456; 249/120

(58) Field of Search ..... 425/253, 456, 425/470, 453, 432, 346, 349, 354; 249/119, 120, 117, 139, 122

(56) References Cited

U.S. PATENT DOCUMENTS 4,235,580 A * 11/1980 Springs et al. ..... 425/211
6,007,321 A * 12/1999 Meckel et al. ..... 425/432

FOREIGN PATENT DOCUMENTS

| | | |
|---|---|---|
| DE | 196 22 001 | 12/1997 |
| DK | 171553 | 1/1997 |
| EP | 0 318 708 | 6/1989 |
| FR | 2 474 940 | 8/1981 |
| GB | 2 276 581 | 10/1994 |

* cited by examiner

*Primary Examiner*—Robert Davis
*Assistant Examiner*—Thu Khanh T. Nguyen
(74) *Attorney, Agent, or Firm*—Nixon Peabody LLP; David S. Safran

(57) ABSTRACT

In connection with the moulding of tiles and bricks, for example for paving etc., use is made of moulding equipment comprising an under-part (16) with moulding cells (18) corresponding to the shape of the tile or brick, and an upper-part (2) with tubes (6) which support downwards-extending pressure plates (8) corresponding substantially to the shape of the moulding cell, and such that the pressure plates (8), in the forming of the items by vertical displacement of the under-part (16), are fed down through the moulding cells (18).

Figure 1:
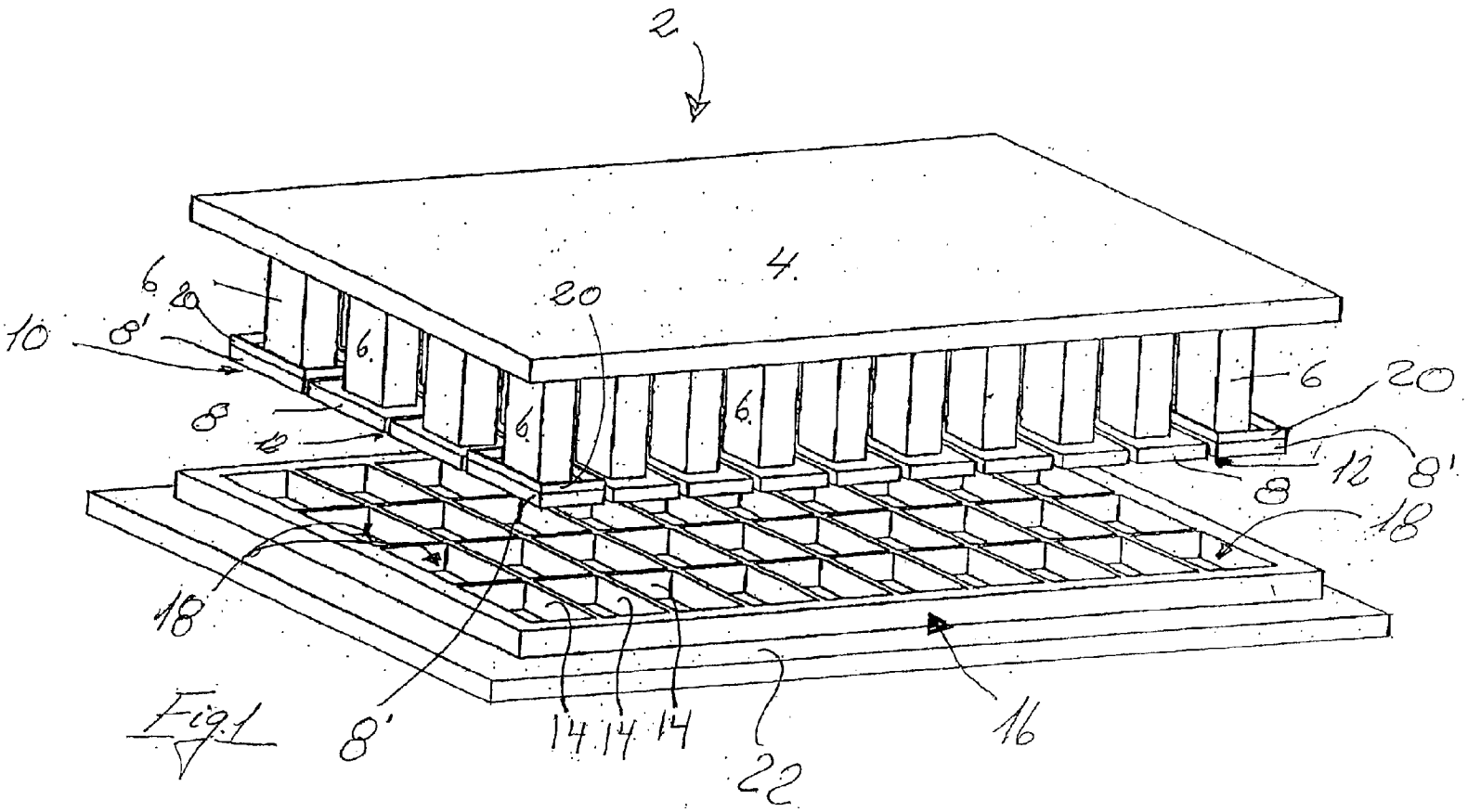

With the invention, there is disclosed an upper-part (2) comprising means whereby the upper-part (2), alternatively the under-part (16), comprises means (20, 24) which ensure that when the under-part (16) is raised to a certain minimum height, which is greater than the thickness of the mould items, the pressure plates (8) maintain their position outside, or their guiding engagement with, the sides (14) of the cell (18) corresponding therewith.

In the forming of the items (28), it is hereby avoided that the pressure plates (8) are guided outside the limits of the cells (14) in the under-part (16).

15 Claims, 4 Drawing Sheets

CONTROLLED MOULDING EQUIPMENT

The present invention relates to moulding equipment for concrete moulding machines of the kind which are typically used for the production of moulded items in the form of tiles and bricks for paving and wall constructions, and comprising a cell-divided under-part with cells which are open both upwards and downwards, and which define the desired basic shape of the individual tiles/bricks, and a corresponding upper-part which from an upper holding plate has downwards-extending pressure plungers which are formed with lower pressure plates which pass down into the respective underlying cells in the under-part, and can hereby be used for downwards ejection of the moulded items from the cells.

The manner in which the equipment is used is that the under-part is placed on a moulding board placed on a vibration table, with the upper-part lying in a raised position over the under-part. A concrete supply carriage is guided in along the upper side of the under-part in the space below the upper-part for the introduction of concrete down into the moulding cells and the full filling of said cells. Upon conclusion of the filling, the supply carriage is withdrawn and the upper-part is lowered until the said pressure plates ram down against the concrete surfaces in the respective moulding cells. Thereafter, the upper-part is used as a multi-pressure plunger for compression of the concrete mass in the individual moulding cells, which is effected under strong vibration of the moulding equipment for the separation of air from the concrete mass. The mould items are hereby compressed to the desired block shape and uniform thickness. Thereafter, the upper-part is held at its end height in relation to the under-part, and power is applied to the under-part for raising this up from the moulding board, whereby the mould items, which by the pressure maintained from the upper-part can not participate in this raising, will remain standing on the moulding board during the relevant forming of the mould items. When the forming is brought to an end by the displacement of the under-part up to a position in which its underside is raised at least to the level of the upper-part's pressure plates, the half-firm mould items can be removed from the vibration table by being pushed out from the table after raising of the upper-part, after which a new moulding cycle can be started after the lowering of the under-part to the moulding board and the raising of the upper-part to its start position.

It is hereby important that in the forming phase, which consists of ejection of the mold items from the molding cells, the under-part is raised to an upper position in which its under-side just moves free of the under-side of the upper-part's pressure plates, and herewith free of the upper-side of the mould items, so that these items can be guided out in the horizontal direction, while the same raising should preferably not be driven so far that the upper-part's pressure plates are exposed down below the under-side of the raised under-part, since this can give rise to problems regarding the subsequent separation of these parts when a new moulding cycle is initiated, i.e. the upper-side of the pressure plates should not emerge from the lower ends of the moulding cells.

The latter problems are particularly that when in the separated condition, the upper-part's pressure plates and the under-part can be displaced in the horizontal direction in relation to one another, so that before the feeding back of the under-part and displacement of the upper-part to the start position, the pressure plates are not positioned opposite the corresponding holes in the under-part, whereby the displacement of the under-part to the start position is not immediately possible without manipulation of the mould parts.

Moreover, the relevant moulding machines should be able to work with moulding equipment with under-parts which have different heights for the formation of mould items with different desired heights (thicknesses), and therefore it is inexpedient to work with special settings of the machine functions, including the extent of the raising of the under-part in connection with the forming.

Especially in the changeover from moulding of items with great thickness to the moulding of items with relatively modest thickness, where the height of the under-part is modest, the adjustment of the machine functions for raising and lowering of the under-part will be relevant in order to prevent the upper-part's pressure plates from being exposed down below the under-side of the raised under-part.

With the invention it has been realised that it is possible to avoid the above-mentioned problem concerning relative horizontal displacement between the upper part and the under-part during the forming of mould items, without special setting of the machine functions, by providing the upper-part or alternatively the under-part with means which ensure that the pressure plates maintain their position opposite the cells in the under-part—or their guiding engagement with the sides of the corresponding cells—when the under-part is raised to a certain minimum height which is greater than the thickness of the mould items.

A preferred embodiment of said means for controlling the mutual positioning between the pressure plates and the cells corresponding therewith, where the moulding equipment is used both for the moulding of items with small thickness as well as items which are considerably thicker in relation hereto, is characterised by the upper-part being provided with at least one guiding pressure plate which is configured with an upwards extension, so that it maintains guiding engagement with the sides of the corresponding cells in the under-part when this is raised to a certain minimum height which is greater than the thickness of the thinnest or lowest under-parts.

Since the pressure plates are secured in the upper-part and can not be displaced in relation to one another, it is thus achieved that providing only one of the pressure plates is held in engagement in its corresponding cell in the under-part, the remaining pressure plates will thus be guided into their respective corresponding cells in the under-part when this is lowered again.

Without renouncing other embodiments of the invention, an embodiment of a guiding pressure plate can consist of a pressure plate with an increased thickness in relation to the remaining pressure plates in the upper-part.

With vertical displacement of the under-part (within limits defined by the thickness of the guiding pressure plate), the guiding pressure plate will hereby maintain its engagement in the corresponding cell, even though the upper-sides of the remaining pressure plates are lying at a level below the upper-side of the under-part.

Since it is the engagement of only the periphery of the pressure plate with the walls of the corresponding cell which is decisive for correct guiding between the upper and lower part, an alternative, preferred and material-saving embodiment of the guiding pressure plate will consist of a pressure plate having an upper-side along the periphery, or at least partly on opposite sides of the periphery, which is provided with an upright edge with an outer periphery which is coincident with the periphery of the pressure plate.

There is hereby achieved the same effect as that when the guiding pressure plate is configured with an increased thickness, but a considerably saving in material is achieved.

There are normally certain tolerances between the upper-part and the lower-part in said moulding machines, and with regard to this it will be preferred that the upper-part comprises at least two or more guiding pressure plates according to the invention. With small tolerances, there will thus be a need for a greater number of guiding pressure plates than with large tolerances.

As already mentioned, the relevant moulding machines should be able to work with moulding equipment which have under-parts of different heights for the formation of tiles/bricks with different desired heights, and therefore it is inexpedient to work with special settings of the machine functions, while it is a simple task to provide stop surfaces directly between the upper and under-part of a given moulding equipment, such that these parts can be allowed to be brought together to an extent that the upper-part's pressure plates will simply not be able to emerge in the space below the under-side of the raised under-part.

It is well-known that such stop surfaces are established by welding downwards-extending pressure pins in the corner areas of the top plate of the upper-part, said pins being of such a length that they will ensure a relevant maximum extent to which the upper and lower-part of the moulding equipment can be brought together, in that they will be hit by corresponding areas of a protruding top-plate on the under-part when this is raised for the releasing of the mould items.

It has been ascertained that in order to achieve a relatively long operative lifetime, the relevant stop pins shall be fastened by particularly robust welds, the reason being that at their fastening they are exposed to a considerable weakening effect as a consequence of the strong vibrations and shock effect during the forming phase, to which they are exposed during every single operative cycle of the moulding equipment.

In light of this, with a second preferred embodiment of the means for the guiding and mutual positioning between the pressure plates and the cells corresponding herewith according to the invention, a better and cheaper solution has been sought, and surprisingly it has been found that such a solution can continue to be based on the "stop-pin principle", merely with the modification that the stop-pin is not secured by welding, but appears as a threaded spindle which extends through a hole in the associated support plate and is fastened to this by the tightening of a nut, i.e. as a simple bolt fastening. Comprehensive tests have shown that a bolt fastened in this manner is far better able to withstand the effects of vibration than even the most carefully-welded stop-pins.

With the invention there is also achieved the considerable advantage that the stop-pins can appear with variable length, where a bolt head on the threaded pin can be replaced with a nut which can be adjusted to different positions on the threaded spindle, and hereby determine its different operative lengths. This is of significance since one and the same upper-part is thus able to be used in connection with different under-parts, which while defining the same basic shape of the mould items, are dimensioned with different heights for producing mould items with correspondingly different thicknesses. Consequently, the invention will also involve an innovation regarding an "adjustable height stop" between the upper and lower parts of the moulding equipment.

In principle, it is of no importance whether the stop-pins extend downwards from the upper-part or upwards from the lower-part, but for different reasons it is preferred that they extend downwards from the upper-part.

Moreover, for cushioning the shock in connection with the contact of the under-part against the stop-pins in the upper-part, the stop-pins can with advantage comprise shock absorbers of a commonly-known type.

Figure 2:
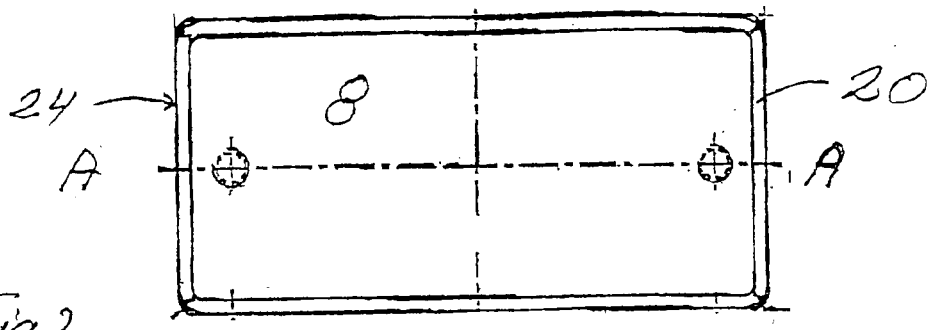
Figure 3:
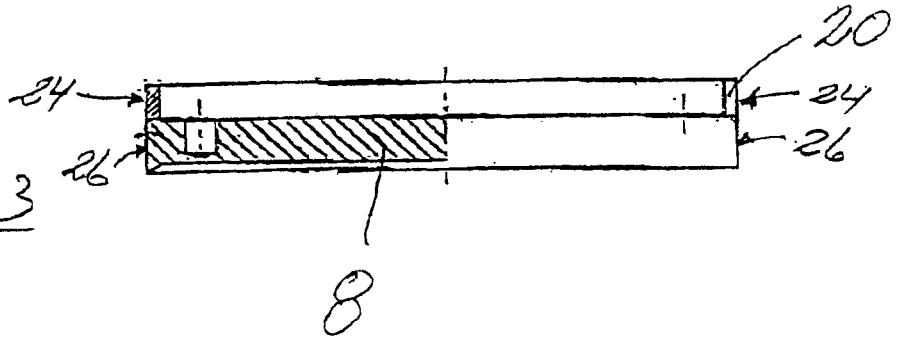
Figure 4:
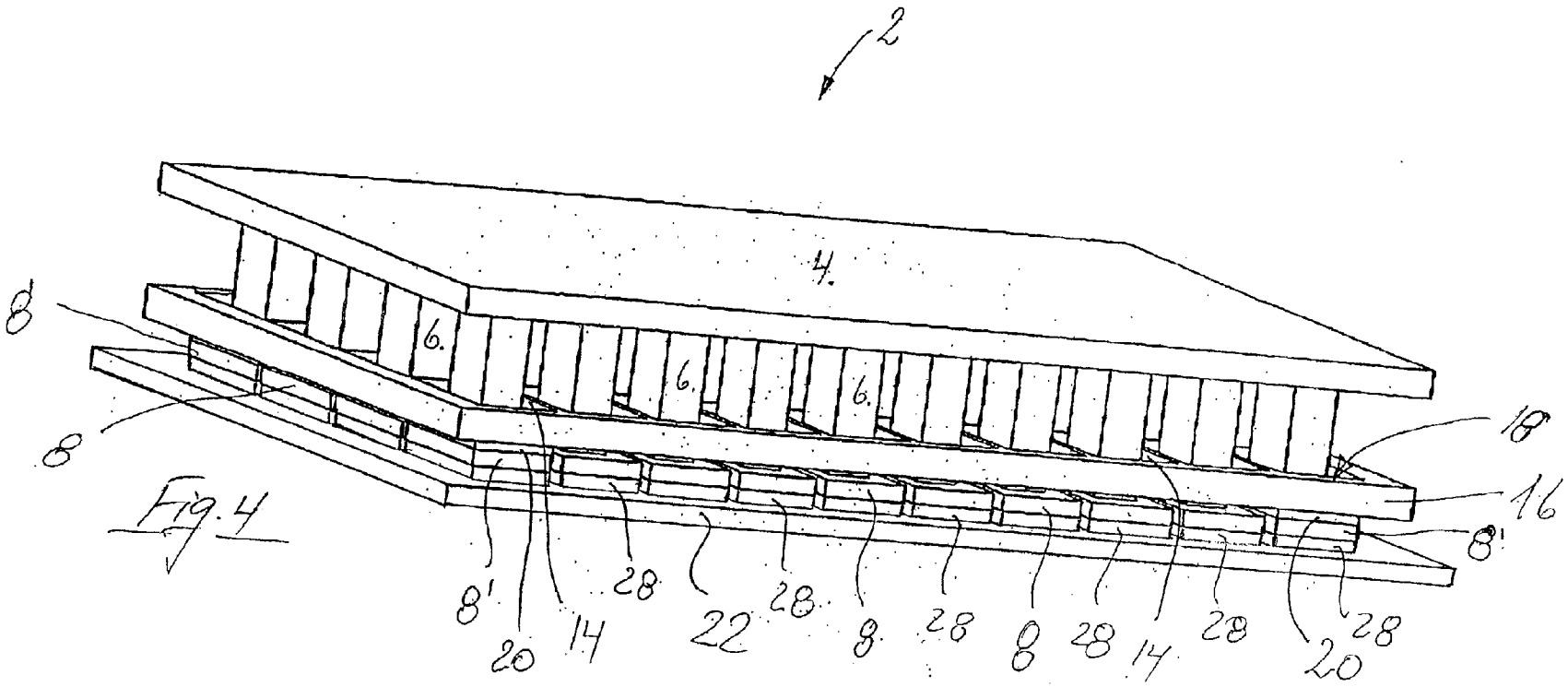
Figure 5:
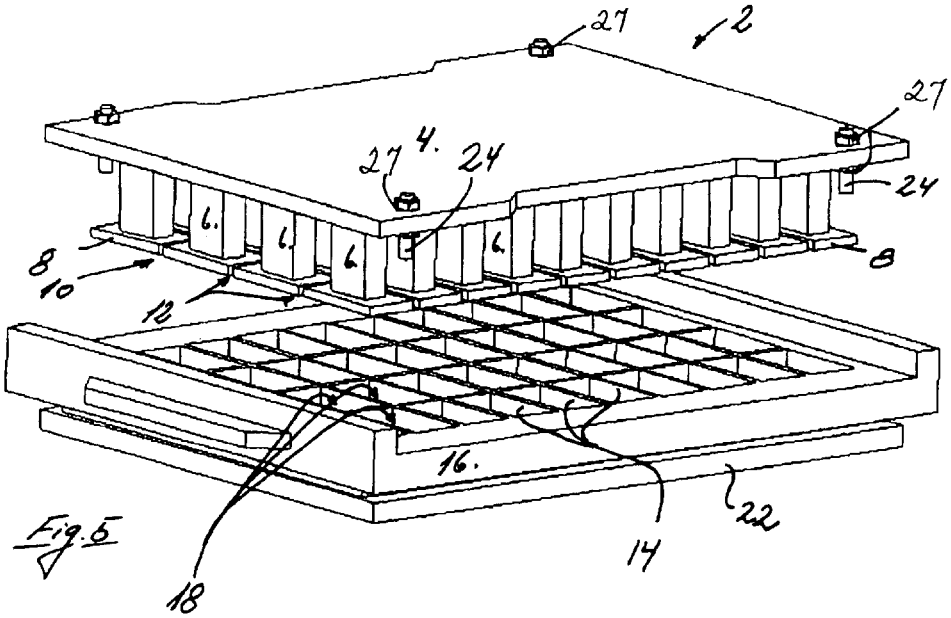
Figure 6:
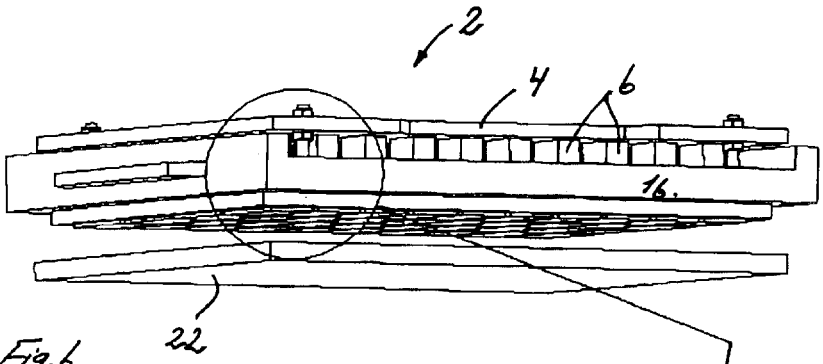
Figure 7:
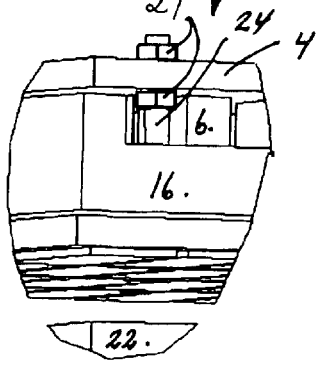

Hereafter, the invention is explained in more detail with reference to the drawing, in which FIG. 1 is a perspective view where a mould upper-part is raised above a mould under-part, FIG. 2 is a plan view of an example embodiment of a guiding pressure plate according to the invention, FIG. 3 is a combined side section view and side view of the guiding pressure plate shown in FIG. 2, FIG. 4 is a perspective view of FIG. 1, where the mould upper-part is driven through the mould under-part, FIG. 5 is a perspective view of the mould upper-part with mould height stop according to the invention raised above a mould under-part, FIG. 6 is a perspective view of FIG. 5, where the mould under-part is raised up into abutment with the mould height stop, and FIG. 7 is detail section of FIG. 6, showing the height stop in function.

In FIGS. 1 and 2 there is shown moulding equipment for a moulding machine.

The shown upper-part 2 (cf. FIG. 1 and FIG. 4) has a solid top plate 4 to which is fastened a number of downwards-extending support tubes 6, which lowermost support welded-on pressure plates 8, each of which has a contour corresponding to the shape of the upper side of the tiles/bricks which are to be moulded. Together, the pressure plates 8 will thus form a bottom plate 10 which is broken by a pattern of slots 12 in between the pressure plates, and this pattern will correspond to the shape of the cell walls 14 which appear in an associated under-part 16, which thus form the said mould cells 18 which are open both upwards and downwards. The moulding equipment shown in FIG. 1 is shown with the upper-part 2 raised above the mould under-part 16, ready for filling with moulding material (concrete).

The under-part 16 is shown lying on a moulding board 22 on a not-shown vibration table.

As will be seen, the upper sides of the pressure plates 8' at the corners of the upper-part 2 are provided with a surrounding, upright collar 20, the outer sides of which lie substantially flush with the cell walls 14 in the corresponding cells 18 in the under-part 16, whereby in the corners the pressure plates 8' become guiding in the forming of the mould items, as will be described in the following.

In FIG. 2 and FIG. 3, which show a plan view and a combined side and side section view along the line A-A respectively of a pressure plate 8' of the kind which is placed at the corners of the upper part 2, the pressure plate 8' is provided along its periphery with a surrounding edge 20 extending up from the upper side, the outer side 24 of said edge 20 extending in extension of and in the same plane as the outer edge 26 of the pressure plate 8'.

After the filling of the cells 18 with concrete and vibration by the vibration table (not shown), and with the pressure plates 8, 8' lowered down in the cells 18 and in contact with the items, the actual forming of the items 28 can be carried out, which in practice is effected by a raising of the under-part 16 with the upper-part 2 stationary, whereby the pressure plates 8 will hold the items 28 down against the moulding board 22, as will appear from FIG. 4. Under normal circumstances, the raising of the under-part 16 will be continued until its lower end lies flush with the under side of the pressure plates 8, so that these plates do not come to emerge through the bottom of the cells 18.

However, as a result of the upright collar 20, the guiding pressure plates 8' in the corners, cf. FIG. 4, make it possible for the raising of the under-part 16 to be able to be continued for a distance which is determined by the height of the collars 20, so that the pressure plates 8 appear below the bottom of the cells 18, since the collars 20 on the pressure plates 8' will still be in engagement with the cell walls 14. It is hereby ensured that the under-side of the under-part 16 can be lifted completely free of that plane which is formed by the tops of the items 28, and hereafter the items can be removed without risk of contact with the underside of the under-part 16, while at the same time that the pressure plates 8, guided by the upright edges 20 on the pressure plates 8', are held in their correct position opposite the cell openings 18 corresponding herewith. Hereafter, the under-part 16 can quickly be displaced back to the start position on the moulding board 22, and the moulding process is repeated.

It shall be mentioned that the inventor has realised that the effect of the guiding pressure plates 8', 20 can be achieved by other embodiments of the invention, for example by forming the pressure plates 8' with a greater thickness than the pressure plates 8, and it is also realised that the edges 20 do not necessarily need to extend along the whole of the peripheries of the pressure plates 8', but merely need to have an extent and positioning on the pressure plates which in a sufficient manner safeguards the pressure plates 8 against relative displacement in relation to the corresponding cell openings 18 in the under-part.

FIG. 5 shows a second embodiment of the means according to the invention which ensure that the pressure plates (8) maintain their position opposite, or their guiding engagement with the sides (14), of the cell (18) corresponding therewith in the under-part (16).

Here, the means consist of stop-pins 24 extending downwards from the underside of the upper-part, said stop-pins being secured to the upper-part 4 by the use of bolts 27.

In FIG. 6 is shown the mentioned situation where the upper-part's pressure plates 8 are fed a distance down into the moulding cells, namely to form a counter-hold against the vibrated and compressed mould items (not shown here) in the cells 18, which are completely filled with concrete beforehand. Hereafter, the actual forming of the items (not shown here) can be carried out, which in practice is effected by a raising of the under-part 16 with the upper-part 4 secured, whereby the pressure plates 8 will hold the items down against the board 22. The raising of the under-part is continued until its lower end is flush with the underside of the pressure plates 8, or such that these plates do not come to emerge through the bottom of the cells 18. This position is determined by the top plate 20 of the under-part abutting against the stop-pins 24 which extend down from the corners of the upper-part's top plate 4.

It is these pins 24 which have hitherto been secured by welding, and which with the invention are secured in a bolt-like manner for achieving a distinctly increased security of stability against the strong vibrations of the moulding equipment. In the shown embodiment, the threaded pins 24 are secured in a double-sided manner by means of the two nuts 26, which will thus in-an obvious manner also make it possible to carry out an adjustment of the position of the height of the lower ends of the pins. It is hereby possible to adjust a relatively high upper-part for co-operation with both high and lower under-parts, typically within the interval of 5–10 cm, and with use of two or more under-parts of the same type, but with different heights for the formation of tiles/bricks with different thicknesses, the overall moulding equipment will thus be made cheaper by different under-parts being able to be used for one and the same upper-part.

If desired, the pins 24 can be arranged in connection with shock absorbers of known type.

FIG. 7 is a detail view of a section of FIG. 6, showing how a stop-pin 24 is in contact with the upper-side of the under-part 16, and where a part of the upper-part's pressure plates 8 appear below the underside of the under-part 16, though without being exposed, whereby a part of the pressure plates 8 remains in engagement with the sides 14 of the cells.

It must be mentioned that an alternative possibility for a relevant height adjustment will be to work with "bottoming pins" 24 of short length, corresponding to the thickest under-part, and thus for thinner under-parts, the use of e.g. leg-blocks with upwardly-open threaded holes or other holding means if the pins are not provided with threads.

What is claimed is:

1. Moulding equipment (2) for concrete moulding machines of the kind which is typically used for the production of mould items in the form of tiles and bricks for paving and wall constructions, and comprising a cell-divided under-part (16) with cells (18) which are open both upwards- and downwards, and which define the desired basic shape of the individual paving tiles or bricks, and a corresponding under-part (2) which from an upper retraining plate (4) has downwards-extending pressure plungers (6) which are formed with lower pressure plates (8) which pass down into respective, underlying cells (18) in the under-part (16), and are hereby usable for downwards ejection of the mould items from the cells (18), wherein the upper-part (2), alternatively the under-part (16), comprises means (20, 24) which ensures that the pressure plates (8) maintain their position opposite the sides, or their guiding engagement with the sides (14) of the therewith corresponding cells (18) in the under-part (16) when the under-part (16) is raised to a certain minimum height which is greater than the thickness of the mould items, during stripping of the mould items from the cell-divided under-part; wherein the means which ensure that the pressure plates (8) maintain their position outside, or their guiding engagement with the sides (14) of the therewith corresponding cells (18) in the under-part (16), consist of the upper-part (2) comprising at least one guiding pressure plate (8') which is configured with upwards extension (20) so that it maintains guiding engagement with the sides (14) of the therewith corresponding cell (18) in the under-part (16) when this is raised to a certain minimum height which is greater than the thickness of the thinnest or lowest under-parts.

2. Moulding equipment (2) according to claim 1, characterised in that the guiding pressure plate (8') consists of a pressure plate with an increased thickness in relation to the remaining pressure plates in the upper-part (2).

3. Moulding equipment (2) according to claim 1, characterised in that the guiding pressure plate (8') consists of a pressure plate which along the periphery of the upper side, or at least partly on opposite parts of the periphery, is provided with an upright edge (20), the outer periphery (24) of which is coincident with the periphery (26) of the pressure plate.

4. Moulding equipment (2) according to claim 1, characterised in that the upper-part (2) comprises at least two or more guiding pressure plates (8').

5. Moulding equipment (2) for concrete moulding machines of the kind which is typically used for the production of mould items in the form of tiles and bricks for paving and wall constructions, and comprising a cell-divided under-part (16) with cells (18) which are open both upwards- and downwards, and which define the desired basic shape of the individual paving tiles or bricks, and a corresponding under-part (2) which from an upper retraining plate (4) has downwards-extending pressure plungers (6) which are formed with lower pressure plates (8) which pass down into respective, underlying cells (18) in the under-part (16), and are hereby usable for downwards ejection of the mould items from the cells (18), wherein the upper-part (2), alternatively the under-part (16), comprises means (20, 24) which ensures that the pressure plates (8) maintain their position opposite the sides, or their guiding engagement with the sides (14) of the therewith corresponding cells (18) in the under-part (16) when the under-part (16) is raised to a certain minimum height which is greater than the thickness of the mould items, during stripping of the mould items from the cell-divided under-part; wherein the means which ensure that the pressure plates (8) maintain guiding engagement with the sides (14) of the therewith corresponding cell (18) in the under-part (16), consist of stops (24) in the form of stop-pins extending downwards from the upper-part's retaining plate (4), which are precisely of such a length they will ensure a relevant maximum bringing-together of the upper-part and under-part of the moulding equipment by their abutment against corresponding areas of the upper-side of the under-part (16) when this is raised for the releasing of the mould items, characterised in that a stop-pin (24) appears as a threaded spindle which is inserted through a hole in the associated retaining plate (4), and is secured to this by the tightening of a nut (26), i.e. as a simple bolt fastening.

6. Moulding equipment (2) according to claim 5, characterised in that the stop-pins (24) can appear with variable, but mutually identical lengths, where a bolt head on the threaded pin (24) is replaced by a nut (26) which can be adjusted to different positions on the threaded spindle, and herewith determine different operative lengths of the spindle.

7. Moulding equipment (2) according to claim 6, characterised in that the stop-pins (24) extend upright form and are fastened to the under-part (16).

8. Moulding equipment (2) according to claim 5, characterised in that the stop-pins comprise shock absorbers.

9. Moulding equipment (2) according to claim 2, characterised in that the upper-part (2) comprises at least two or more guiding pressure plates (8').

10. Moulding equipment (2) according to claim 3, characterised in that the upper-part (2) comprises at least two or more guiding pressure plates (8').

11. Moulding equipment (2) according to claim 6, characterised in that the stop-pins comprise shock absorbers.

12. Moulding equipment (2) according to claim 7, characterised in that the stop-pins comprise shock absorbers.

13. Moulding equipment (2) according to claim 5, characterised in that the stop-pins (24) extend upright form and are fastened to the under-part (16).

14. Moulding equipment according to claim 13, characterised in that the stop-pins comprise shock absorbers.

15. Molding equipment for concrete molding machines for the production of molded items in the form of tiles and bricks for paving and wall constructions, comprising:

a cell-divided under-part having a plurality of cells which are open both in upward and downward directions, and which define a basic shape of the individual paving tiles or bricks, and a corresponding upper-part having an upper retraining plate from which pressure plungers extend in a downward direction, the plungers being formed with lower pressure plates which pass down into respective cells in the under-part and which also constitute ejectors for downward ejection of mold items from the cells, wherein guidance means are provided for ensuring the pressure plates maintain their position with respect to sides of corresponding cells in the under-part when the pressure plates and under-part have been displaced toward relative to each other by a distance which is greater than the thickness of the mold items causing the pressure plates to pass through the cells so as strip the molded items from the cell-divided under-part; wherein said guidance means comprises at least one of the pressure plungers having a guiding pressure plate configured and located in a manner which causes the guiding pressure plate to maintain guiding engagement with the sides of the respective cell in the under-part when the pressure plates of the plungers which are not provided with a guiding pressure plate have emerged from the underside of the cells of the under-part.

* * * * *